United States Patent [19]

Panse et al.

[11] Patent Number: 4,463,954

[45] Date of Patent: Aug. 7, 1984

[54] AQUATIC DEVICE

[76] Inventors: Richard G. Panse; Jane E. Panse, both of 903 Lake Shore Dr., Apt. 107, Lake Park, Fla. 33403

[21] Appl. No.: 448,784

[22] Filed: Dec. 10, 1982

[51] Int. Cl.[3] ..... A63B 65/10; A63B 67/06

[52] U.S. Cl. ..... 273/424; 273/128 R; 441/67

[58] Field of Search ..... 273/424, 425, 126 R, 273/128 R, 428; 441/65–67, 136

[56] References Cited

U.S. PATENT DOCUMENTS

| | | | |
|---|---|---|---|
| 2,762,063 | 9/1956 | Quinn | 441/67 |
| 3,183,002 | 5/1965 | Updaw | 273/424 X |
| 3,716,880 | 2/1973 | Sorenson | 441/67 |
| 4,151,997 | 5/1979 | Glovak et al. | 273/424 |
| 4,212,462 | 7/1980 | Glovak et al. | 273/424 |
| 4,354,326 | 10/1982 | Mathews | 273/424 X |

*Primary Examiner*—Paul E. Shapiro

*Attorney, Agent, or Firm*—Wolf, Greenfield & Sacks

[57] ABSTRACT

An aquatic surface projectile for recreation and/or exercise use either individually or in team play. The aquatic device is manually propelled by throwing so as to skim along the surface of a body of water in a smooth skimming action and not by skipping or tumbling. The lower surface of the projectile is preferably an inverted frusto-conical shape, with shape variables including the inner radius, the outer radius, and the altitude angle. The lower surface shape produces a positive, nose-up attitude and hydrodynamic lift to reduce drag for enhancing range and velocity of the projectile while providing smooth skimming on the water surface. In addition to the projectile shape considerations, the projectile is also made relatively lightweight to provide enhanced skimming action and to prevent undesired skipping and tumbling of the projectile.

9 Claims, 7 Drawing Figures

AQUATIC DEVICE

BACKGROUND OF THE INVENTION

The present invention relates in general to an aquatic surface-skimming device and on the other hand pertains, more particularly, to an aquatic device that may be used as an aquatic toy for recreation or exercise use wherein one or more participants manually throw or otherwise propel the device, as a projectile, in a particular direction across the surface of a body of water whereupon the device becomes supported by hydrodynamic forces. In this regard it is an objective of the present invention to provide such an aquatic device wherein the hydrodynamic forces support the projectile in a skimming action over the surface of a body of water, with the design being such as to prevent any skipping or tumbling of the projectile relative to the surface of the body of water.

The utilization of projectiles, especially balls or aerodynamically shaped objects for throwing through the atmosphere is quite well-known. Ball games as such go back to antiquity in terms of being used for both recreation and exercising. Surface-skimming projectiles such as hockey pucks have been used also for sporting events such as hockey games in which the objective is to place the projectile into a net that is established as the goal.

Water sports have employed balls as the game projectile in such a manner that participants pass the ball to each other, usually through the air, the ball being buoyant, much like a basketball, although it is played in the water. Because of the spherical shape of a ball, a ball does not exhibit desirable characteristics for use as a surface-skimming projectile, and is not meant to have any appreciable surface-skimming range when thrown.

Various types of projectiles and discs are described in the following patents: U.S. Pat. No. 12,801, W. J. Von Kammerhueber; U.S. Pat. No. 1,006,628, E. M. Burr; U.S. Pat. No. 2,223,091, G. T. Bresnahan et al; U.S. Pat. No. 2,864,201, R. G. Leise; U.S. Pat. No. 3,312,472, R. A. Kerr. With regard to these prior art patents, by way of example, the Bresnahan et al patent shows a discus intended to be thrown through the air. This structure is not taught as for use in connection with a body of water and furthermore the weight of this device is excessive if applied in a water-air interface environment. Further, by way of example the Leise patent shows an inflated disc of quite different geometric construction that also is of relatively heavy weight particularly in comparison with the structure of the present invention. In both the Leise and Bresnahan devices, as to be discussed in more detail hereinafter, it is not possible to obtain a smooth surface-skimming action on water that is obtained with the device of the present invention. Both of these prior art devices are capable primarily of only a skipping action when used in an air-water interface environment.

Accordingly, it is an object of the present invention to provide an aquatic device which is specially shaped hydrodynamically so as to provide a smooth skimming action when the projectile is thrown.

Another object of the present invention is to provide an aquatic device which is characterized by enhancement in its stability, increased range, and increased velocity when manually thrown or otherwise projected by a user in a surface-skimming motion across a surface of a body of water.

SUMMARY OF THE INVENTION

To accomplish the foregoing and other objects of this invention there is provided an aquatic device that is particularly adapted to be projected for skimming upon and across the surface of a body of water, just over the water surface essentially at the air-water interface. This aquatic surface projectile may be used for recreation, sports, or exercise either by an individual or a group of individuals. The aquatic device of this invention comprises a buoyant body having an upper portion and a lower portion with both of these portions being formed so as to include a peripheral locus and to define a buoyant body of a preselected radius. The lower portion in particular is constructed so as to provide proper hydrodynamic force support to assure smooth skimming of the buoyant body upon and across the surface of a body of water at the aforementioned air-water interface. During skimming the forward portion of the peripheral locus is supported out of contact with the surface of the water. This lower portion of the buoyant body is basically separated into two different contours including a central bottom area of a predetermined radius forming a substantially flat bottom surface, and a tapered wall surface extending peripherally and outwardly from the perimeter of this central bottom area and tapered upwardly by a predetermined small angle alpha to the peripheral locus of the body. The angle alpha (also referred to as the altitude angle) is typically less than 8.5°, though its exact value is interdependent with the other geometric design variables mentioned and with the body weight. Together, these design parameters provide proper hydrodynamic forces for lift and a nose-up attitude and enhance skimming range when the body is skimming across the surface of the body of water at the air-water interface. In one embodiment of the present invention the lower portion of the body is substantially an inverted frusto-conical shape. In accordance with the invention it is preferred that the radius ratio between the central bottom area and the tapered wall surface be maintained in a certain range, particularly in conjunction with the altitude angle to create a body shape wherein the body experiences a smooth skimming action as it moves along or over the surface of water. The control of these parameters provides a certain upward disposition of the projectile to enhance the skimming effect across the water.

With respect to the upper portion of the buoyant body, this may be flat or it may be constructed with other shapes to either enhance certain aerodynamic qualities or style or grasp or certain balance and equilibrium qualities of the device so as to enhance the skimming action over the surface of the water. It is also possible in accordance with the invention that the upper portion and the lower portion of the body be made symmetrical about the central horizontal plane through the body so that the device may be utilized on either side.

In accordance with the present invention the preferred shape of the body is one that is substantially circular. However, the peripheral shape of the body may be varied to a polygon or various shapes or sizes so long as the surface configuration of the lower portion of the body is maintained.

With respect to the tapered wall surface, this may be flat (i.e. conical) so as to provide a true frusto-conical shaped projectile. Alternatively, the tapered wall surface may be concave or convex or may include segments that are respectively concave and convex in a radial cross sectional plane, to be described in further detail hereinafter.

BRIEF DESCRIPTION OF THE DRAWINGS

Numerous other objects, features and advantages of the invention should now become apparent upon a reading of the following detailed description taken in conjunction with the accompanying drawings in which.

DETAILED DESCRIPTION

Figure 2:
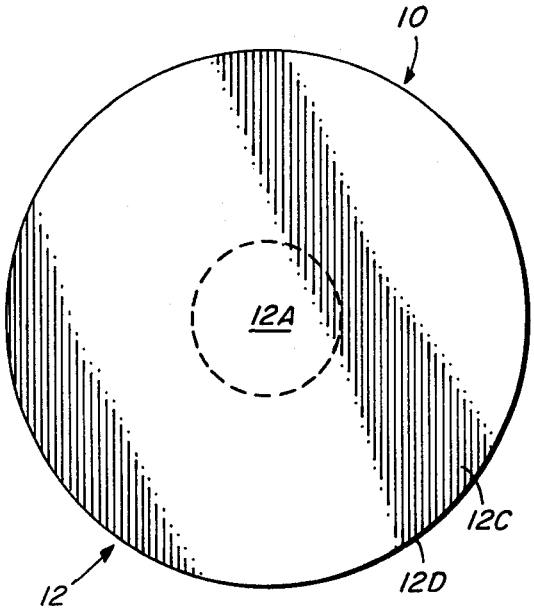
FIG. 2 is a top plan view of the embodiment illustrated in FIG. 1.
Figure 1:
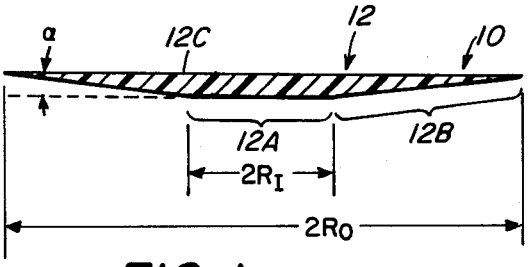
FIG. 1 is a side elevational view in radial cross section of one embodiment of the present invention.

Reference may now be made to the first embodiment described herein with reference to FIGS. 1 and 2. The aquatic device 10 comprises a buoyant body 12 constructed of a suitable material, or alternatively of hollow construction, so that the body is buoyant. In the embodiment illustrated in FIG. 2 the body has a generally circular shape and in a cross section has a frusto-conical shape (shown inverted).

The lower portion of the body 12 includes a central bottom area 12A forming a substantially flat bottom surface. It is noted that the surface 12A is substantially parallel to the plane of the surface 12C. In this embodiment the surface 12A is circular, flat, and is centrally located. This surface is contiguous with and is utilized in conjunction with the peripheral tapered surface 12B which in a sense forms the side of the cone. This surface is disposed at an angle alpha relative to the plane of the surface 12A. Acceptable values for the angle alpha and other parameters are discussed in further detail hereinafter in connection with evaluation of the operation of the aquatic device of this invention and in connection with the data tables to be discussed hereinafter. Moreover, as discussed in further detail hereinafter, there are geometrical relationships between the angle alpha, the radius of the surface 12A, $R_I$ and the radius of the surface 12C, $R_O$, for establishing the proper hydrodynamic effect.

Figure 7:
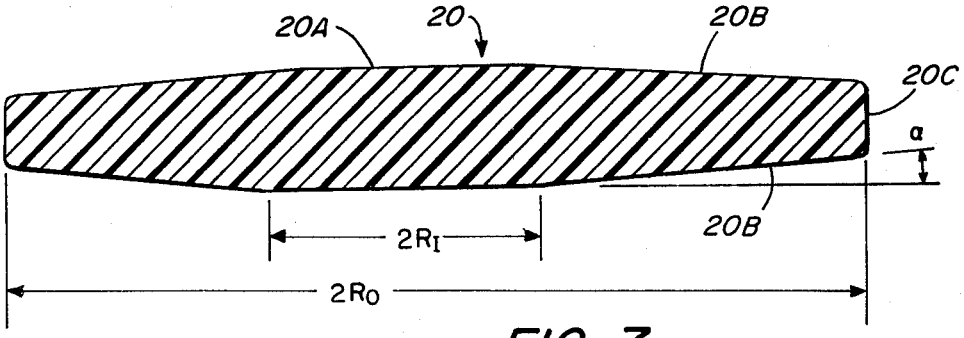
FIG. 7 shows still another embodiment of the present invention in radial cross section and in which the device may be used on either side.

In FIG. 1 the upper surface 12C of the body has been shown flat. However, it is understood that this surface may take on many different shapes such as illustrated in FIG. 7. The upper surface shape is not for contact with the body of water (except in the version of FIG. 7.) The shape of this upper surface 12C may be selected to enhance stability, grasp, style, weight distribution, or certain aerodynamic features to enhance the aerodynamic characteristics of the device.

Figure 3:
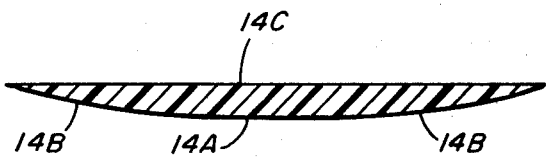
FIG. 3 shows an alternate embodiment in radial cross section in a side elevation view of the present invention.

FIG. 3 shows an alternate embodiment of the present invention in which the body member includes a flat, upper planar surface 14C, a lower flat central portion 14A, and convex peripheral surfaces which join the periphery of surface 14A out to the extreme perimeter of the device. This convex peripheral surface 14B provides one form of a tapered surface. With the arrangement of FIG. 3 there is still ensured a proper angular relationship between the flat, small bottom portion 14A and the convexed sides.

Figure 4:
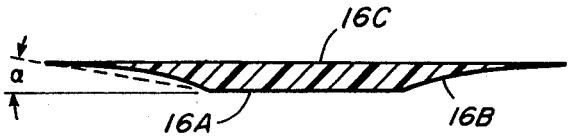
FIG. 4 shows yet another side elevation view of a radial cross section of an alternate embodiment of the present invention.

FIG. 4 shows another alternate shape for the buoyant body. In FIG. 4 there is provided a flat upper surface 16C, and a small radius bottom central surface area 16A. There is also provided a peripheral wall structure that is in the example of FIG. 4 concave. This is identified as surface 16B. Again, the proper angular relationship between the plane of the lower surface 16A and the extreme periphery of the body is maintained. Note the angle alpha also referenced in FIG. 4.

Figure 5:
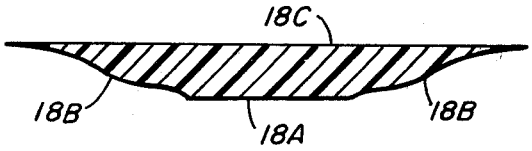
FIG. 5 shows a side elevation view in radial cross section of a yet another alternate embodiment of the present invention.
Figure 6:
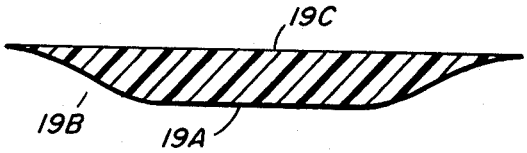
FIG. 6 is a side elevation view in radial cross section of still another alternate embodiment of the present invention.

FIG. 5 shows yet another alternate embodiment including the large radius upper surface 18C and the lower central flat small radius surface 18A. There is provided a somewhat undulated peripheral surface 18B extending peripherally from the extreme edge of surface 18A out to the extreme edge of the device. The surface 18B is a composite of concave and convex surfaces in which a concave surface is adjacent to the surface 18A. In FIG. 6 there is provided a top large radius surface 19C and a lower portion small radius surface 19A. The surface 19A continues into a somewhat undulated peripheral surface 19B that again is a combination of concave and convex portions. In the embodiment of FIG. 6, however, a convex portion is adjacent to the small radius central flat area 19A.

FIG. 7 shows an alternate embodiment using a pair of frusto-conical surfaces that are unitarily formed as one device in which the upper surface is symmetrical with the lower surface through a central horizontal plane. This allows the device to be utilized for skimming on either side. In this embodiment, the central smaller radial surface 20A is substantially flat, with a peripheral wall 20C surrounding the device. The surfaces 20B which form the walls of the cone are disposed at an angle alpha relative to the plane passing through the lower and upper surfaces 20A such that when the lower surface 20A of the skimming device contacts the water surface, angle alpha establishes a positive upward vertical pressure and tends to provide a nose-up attitude for proper skimming.

As indicated previously, the preferred form of the aquatic device of this invention is one in which the lower portion thereof has an inverted frusto-conic shape. A number of tests have been conducted and the results thereof are depicted in Data Tables I and II set forth herein. These tests indicate certain parameters to be discussed in further detail that are pertinent in providing the proper skimming action for the aquatic device. The parameters that have been examined include the weight on a weight per square inch basis, the small and large radii, $R_I$ and $R_O$, of the device, and the angle "alpha", or altitude angle. These tests as indicated, for example, in Data Table I have been separated into a series of model designations including model Nos. 1–14. Model No. 5 has a shape similar to that of the aforementioned Bresnahan patent; however, the weights that are selected in model No. 5 are substantially lighter than the weight disclosed in the Bresnahan patent. It has been found that a weight on the order of that taught in the Bresnahan patent (3 pounds, nine ounces) does not achieve any skimming action but instead is characterized by a brief unstable skipping or tumbling action followed by rapid sinking. Data Table I also illustrates the aforementioned Leise patent construction in Model No. 14. However, with this Leise construction there was absolutely no skimming and thus the figures for mean distance skimmed all indicate zero, as is shown in the table. There also is no skimming with the Leise construction when tested at the heavier weights taught in the Leise patent (2 pounds and 4 pounds 6 ounces). It is apparent that in the case of the Leise construction, the Leise construction itself, regardless of weight, does not permit skimming action.

In this invention "smooth skimming" is provided when, given a horizontal velocity, the projected body travels along the surface of the body of water for a substantial distance with very little reduction in speed and with minimal wave formation. The word "skim" as opposed to the word "skip" indicates that the travel is by continuous contact with the water surface and not by intermittent contact with the water surface. "Smooth skimming" indicates that the moving body maintains a substantially constant tilt attitude and a corresponding constant amount of nose lift. This means that the skimming body, once obtaining a position on the water surface, translates with neither up and down oscillation nor attitudinal oscillation. In this connection it is noted that different categories of skimming may also be considered. For example, medium smooth skimming may be defined as a condition in which the body skims by continuous contact except that a small amount of oscillation is observed. There may also be defined choppy skimming in which the body, as a whole, skims by continuous contact except that a moderate amount of oscillation and wave formation are easily observed, and the frequency of attitudinal oscillation is such that an audible "pitter patter" is made by the forward underside surface of the body contacting the water surface in oscillatory fashion, without, however, permitting the forward peripheral locus to dip into the water surface. On the other hand skipping indicates that the body travels along the water surface by intermittently contacting the water surface. The projected body is considered to pitch, tumble, flip or deflect, this is a condition when the body is very unstable about the horizontal plane and the forward peripheral locus is prone to dip beneath the surface of the water. Deflection from a given path often accompanies these unstable characteristics as manifested by an abrupt change of the body direction.

The present invention provides for a design range of aquatic surface skimming devices by specifying compatible ranges of the basic design parameters; angle "alpha," radius ratio ($R_I/R_O$), and weight-to-plan-area ratio, weight/$\pi R_O^2$. A designer can vary the values of the basic parameters within the compatible ranges herein specified to achieve a variety of sizes and variety of enhanced skimming performance.

It is noted in Data Table I, for the models tested, that the models based on the Bresnahan and Leise constructions demonstrated inferior skimming distance compared with all other models tested. The Bresnahan and Leise constructions are outside the specified parameter combinations of the present invention while all other models tested have parameter combinations which fall within the definitive specifications of the present invention. Not only were the skimming distances of the Bresnahan and Leise models inferior to the skimming distances of models of the present invention when released at the same initial velocities, but also the other skimming characteristics of the Bresnahan and Leise configurations were inferior to models of the present invention. The skimming performance of the Bresnahan construction was characteristically very choppy, thus reducing the smoothness and skimming distance of the device when compared with the present invention.

It is also noted in Data Table I that weights are expressed in terms of ounces per square inch. This permits the definition of acceptable weights for various sizes of the present invention. As shown in Data Table I for the models tested, the weight-to-area-ratio was varied between 0.0792 and 0.2326 (weight-to-area-ratio for the device of the Bresnahan patent is 1.0663 oz./in$^2$). For example, given an aquatic device measuring 6 inches in diameter, this range of weight-to-area-ratio would correspond to a weight range of 2.2 ounces to 6.6 ounces. For such a device the lighter weights (and correspondingly low moments of inertia about the center of mass) would be relatively more vulnerable to interference by wind and waves. Thus, it could be expected that average skimming distances and consistency would tend to be less favorable, but acceptable skimming could be expected under calm conditions. At higher weights in that range of 2.2 to 6 ounces a designer would expect increased stability and resistance to wind and wave conditions, increased skimming distances for a given initial velocity, and slightly more choppy skimming than at lighter weights in the range. At weights much higher than 6.6 ounces but still substantially less than found in the prior art constructions, a designer would expect, depending somewhat on the other design parameters, the skimming performance to become excessively choppy and decreased in distance. With additional weight increase the designer would expect that the hydrodynamic lift would be insufficient to support the device in its elevated skimming position.

Another important design parameter illustrated from Data Table I is the angle alpha. It is noted for model No. 5 this angle is indicated as 10°. This corresponds with the structure shown in the Bresnahan patent. Although the Bresnahan patent does not teach a specific angle one has been measured on the drawings and it indicates an angle of 10°. However, it has been found in accordance with the present invention that smaller alpha angles tend to provide longer skimming distances. For example, model No. 7 with an alpha angle of 1°, achieves a maximum skim distance of 24.64 feet, when given an initial velocity of 16 feet/sec. On the other hand model No. 5 (with an arbitrarily low weight ratio) achieves a maximum skimming distance of only 14.99 feet with the same initial velocity.

Increasing the alpha angle to values around 6 or 8 degrees tends to reduce skimming distance and increase choppiness of the device, while also providing more consistent performance and more wind and wave resistance by assuring that the forward locus of the device is positioned high enough above the water surface to avoid dunking. Again, reference is made to model No. 5 where the exceedingly large alpha angle causes excessive choppiness of skim, and greatly reduces skimming distances.

With regard to the radius ratio $R_I/R_O$ it is noted that as with the angle alpha, an increase in this ratio tends to reduce skimming distance for a given value of alpha while increasing choppiness. As indicated previously, increasing the weight to plan area ratio also tends to increase the choppiness of the skim. For example, considering models 7–9, all having an alpha angle of 1°, it is noted that as the radius ratio is increased from one model to the next, the maximum skim distance decreases. Accordingly, when designing devices with relatively high alpha angles (6° to 8.5°); which increases choppiness and reduces skim distance, it is also preferred to have a radius ratio on the order of 0.5 or less. By maintaining the radius ratio below 0.5 it has been found that devices in accordance with the invention may operate with alpha angles even up to about 8.5°, and still achieve significantly better skimming performance than model No. 5.

Having described a limited number of embodiments of the present invention, it should now be apparent to those skilled in the art that numerous other embodiments are contemplated as falling within the scope of this invention.

TABLE I

STATISTICAL RESULTS FOR TESTING OF SKIMMING PERFORMANCE OF THE PANSE AQUATIC DEVICE, THE BRESNAHAN DISCUS, AND THE LEISE INFLATED DISCUS

| | ounces per square inch | mean distance skimmed | ± | limits of error* (80% confidence level) | |
|---|---|---|---|---|---|
| Model #1 | 0.1132 oz/in$^2$ | 18.33 ft. | | 0.19 ft. | |
| Alpha = 7° | 0.1494 | 20.31 | | 0.37 | |
| $R_I/R_0$ = 0.35 | 0.1856 | 20.22 | | 0.74 | |
| | 0.2218 | 19.96 | | 0.66 | |
| Model #2 | 0.1132 | 19.33 | | 0.41 | |
| Alpha = 7° | 0.1494 | 19.48 | | 0.83 | |
| $R_I/R_0$ = 0.5 | 0.1856 | 16.85 | | 1.14 | |
| | 0.2218 | 18.25 | | 1.38 | |
| Model #3 | 0.1132 | 17.27 | | 2.69 | See Table II |
| Alpha = 7° | 0.1494 | 15.61 | | 0.84 | |
| $R_I/R_0$ = 0.7 | 0.1856 | 13.16 | | 1.25 | |
| | 0.2218 | 10.38 | | 1.03 | |
| Model #4 | 0.1188 | 17.72 | | 0.46 | |
| Alpha = 7° | 0.1550 | 19.08 | | 0.59 | |
| $R_I/R_0$ = 0.15 | 0.1901 | 20.25 | | 0.87 | |
| | 0.2264 | 20.16 | | 0.55 | |
| Model #5 | 0.1132 | 14.36 | | 0.52 | |
| Bresnahan Shape | 0.1494 | 13.58 | | 0.57 | |
| Alpha = 10° | 0.1856 | 14.99 | | 0.40 | |
| $R_I/R_0$ = 0.25 | 0.2218 | 14.30 | | 0.88 | |
| Model #6 | NOT AVAILABLE FOR TESTING DUE TO MACHINE SHOP ERROR | | | | |
| Alpha = 1° | | | | | |
| $R_I/R_0$ = 0.15 | | | | | |
| Model #7 | 0.0877 | 12.19 | | 7.84 | See Table II |
| Alpha = 1° | 0.1058 | 20.86 | | 0.34 | |
| $R_I/R_0$ = 0.35 | 0.1420 | 21.64 | | 0.53 | |
| | 0.1783 | 22.35 | | 1.06 | |
| | 0.1964 | 23.00 | | 1.34 | |
| | 0.2326 | 24.64 | | 0.43 | |
| Model #8 | 0.0962 oz/in$^2$ | 15.05 ft. | | 2.32 | see Table II |
| Alpha = 1° | 0.1143 | 19.61 | | 1.54 feet | " |
| $R_I/R_0$ = 0.5 | 0.1505 | 21.02 | | 0.19 | |
| | 0.1867 | 22.55 | | 0.50 | |
| | 0.2230 | 23.44 | | 0.46 | |
| Model #9 | 0.1086 | 17.66 | | 3.31 | |
| Alpha = 1° | 0.1449 | 19.89 | | 0.60 | |
| $R_I/R_0$ = 0.7 | 0.1811 | 21.19 | | 0.29 | |
| | 0.2173 | 21.63 | | 1.01 | |
| Model #10 | 0.0849 | 18.75 | | 0.64 | |
| Alpha = 3.5° | 0.1211 | 21.83 | | 0.57 | |
| $R_I/R_0$ = 0.15 | 0.1573 | 22.83 | | 1.12 | |
| | 0.1935 | 21.25 | | 0.78 | |
| | 0.2297 | 21.11 | | 1.28 | |
| Model #11 | 0.0792 | 18.10 | | 0.56 | |
| Alpha = 3.5° | 0.1154 | 18.67 | | 0.63 | |
| $R_I/R_0$ = 0.35 | 0.1517 | 20.94 | | 0.11 | |
| | 0.1879 | 22.47 | | 0.54 | |
| | 0.2241 | 23.17 | | 0.27 | |
| Model #12 | 0.1019 | 18.97 | | 1.09 | |
| Alpha = 3.5° | 0.1200 | 20.66 | | 0.19 | |
| $R_I/R_0$ = 0.5 | 0.1562 | 21.36 | | 0.86 | |
| | 0.1924 | 22.08 | | 0.59 | |
| | 0.2286 | 20.21 | | 1.30 | |
| Model #13 | 0.0849 | 17.06 | | 1.52 | |
| Alpha = 3.5° | 0.1211 | 20.04 | | 1.36 | |
| $R_I/R_0$ = 0.7 | 0.1573 | 18.75 | | 1.36 | |
| | 0.1935 | 19.52 | | 1.20 | |
| | 0.2297 | 19.33 | | 0.73 | |
| LEISE (#14) | 0.0877 | 0 | | 0 | |
| INFLATED | 0.1058 | 0 | | 0 | |
| DISCUS | 0.1420 | 0 | | 0 | |
| | 0.1783 | 0 | | 0 | |
| | 0.1964 | 0 | | 0 | |

TABLE I-continued

STATISTICAL RESULTS FOR TESTING OF SKIMMING PERFORMANCE OF THE PANSE AQUATIC DEVICE, THE BRESNAHAN DISCUS, AND THE LEISE INFLATED DISCUS

| ounces per square inch | mean distance skimmed | ± limits of error* (80% confidence level) |
|---|---|---|
| 0.2326 | 0 | 0 |

$$* = \frac{\text{standard deviation of individual distances}}{\text{no. of trials}} \times \text{'t score' (80\% confidence)}$$

TABLE II

REVIEW OF PERFORMANCE CONDITIONS FOR POINTS WITH STATISTICAL LIMITS OF ERROR GREATER THAN PLUS OR MINUS 1.5 FEET

| Model | Alpha | $R_I/R_O$ | Weight Area | Limit of Error | Mean | Remarks |
|---|---|---|---|---|---|---|
| #3 | 7° | 0.7 | 0.1132 | 2.69 | 17.27 | Very choppy skim resulted in near-dunk as forward edge re-contacted water surface |
| #7 | 1° | 0.35 | 0.0877 | 7.84 | 12.29 | Abortive dunks at various distances probably due to low alpha and low weight |
| #8 | 1° | 0.5 | 0.0962 | 2.32 | 15.05 | Abortive dunks at various distances probably due to low alpha and low weight |
| | 1° | 0.5 | 0.1143 | 1.54 | 19.61 | Abortive dunks at various distances probably due to low alpha and low weight |
| #9 | 1° | 0.7 | 0.1086 | 3.31 | 17.66 | Abortive dunks at various distances probably due to low alpha and low weight |
| #13 | 3.5° | 0.7 | 0.0849 | 1.52 | 17.06 | Cannot explain; performance was medium smooth |

What is claimed is:

1. An aquatic device that is to be manually thrown or otherwise projected for skimming upon and across the surface of a body of water essentially at the air-water interface, said aquatic device comprising; a buoyant body having an upper portion and a lower portion together defining said buoyant body having a peripheral locus on a predetermined radius, $R_O$, said lower portion including a central bottom area of a predetermined radius, $R_I$, said body including a tapered wall surface extending peripherally and outwardly from the perimeter of said central bottom area and tapered upwardly from said central bottom area by a predetermined small angle "alpha" to the peripheral locus of said body, said angle "alpha" being less than about 8.5° measured from said central bottom area, and having a value predetermined with relation to the ratio $R_I/R_O$ and the weight per plan-area-ratio of the device, where said radius ratio does not exceed 0.8 and said weight per plan-area ratio does not exceed 0.35 oz/in$^2$, so as to provide hydrodynamic forces for skimming when said body is projected across said water-body surface.

2. An aquatic device according to claim 1 in which the angle alpha, the radius ratio $R_I/R_O$, and the weight-per-plan-area ratio are interrelated as follows;

$1° \leqq \text{alpha} \leqq 6°$ $0 < R_I/R_O \leqq 0.8$ $0.0750 \text{ oz/in}^2 \leqq \text{weight}/\pi R_O^2 \leqq 0.3500 \text{ oz/in}^2$.

3. An aquatic device according to claim 1 in which the angle alpha, the radius ratio $R_I/R_O$, and the weight-per-plan-area ratio are interrelated as follows;

$6° < \text{alpha} \leqq 8.5°$ $0 < R_I/R_O \leqq 0.5$ $0.0750 \text{ oz/in}^2 \leqq \text{weight}/\pi R_O^2 \leqq 0.3500 \text{ oz/in}^2$.

4. An aquatic device according to claim 1 in which the tapered walls are conical.

5. An aquatic device according to claim 1 in which the tapered walls are convex as seen in a radial cross section of the device.

6. An aquatic device according to claim 1 in which the tapered walls are concave as seen in a radial cross section of the device.

7. An aquatic device according to claim 1 in which the tapered walls are successively concave and convex as seen in a radial cross section of the device, with a concave portion adjoining said substantially flat central area.

8. An aquatic device according to claim 1 in which the tapered walls are successively convex and concave as seen in a radial cross section of the device, with a convex portion adjoining said substantially flat central area.

9. An aquatic device according to claim 1 in which the periphery of said central area and the adjoining periphery of said tapered wall surface are contoured to meet each other gradually.

* * * * *